US006234946B1

(12) United States Patent
Fricano

(10) Patent No.: US 6,234,946 B1
(45) Date of Patent: May 22, 2001

(54) METHOD FOR CUTTING STRIP TO PRODUCE GRIPS FOR BAG

(76) Inventor: Phillip J. Fricano, P.O. Box 4571, Scottsdale, AZ (US) 85261-4571

( * ) Notice: Subject to any disclaimer, the term of this patent is extended or adjusted under 35 U.S.C. 154(b) by 0 days.

(21) Appl. No.: 09/157,838

(22) Filed: Sep. 21, 1998

Related U.S. Application Data

(63) Continuation-in-part of application No. 08/964,555, filed on Nov. 5, 1997, now abandoned.

(51) Int. Cl.[7] ..... B31F 7/00; B65D 33/06

(52) U.S. Cl. ..... 493/340; 294/137; 294/171

(58) Field of Search ..... 294/1.1, 25, 31.2, 294/33, 27.1, 57, 137, 145, 153, 158, 165, 166, 170, 171; 16/110 R, 114 R, 114 B, 110.1, 114.1, 406; 229/117.09, 117.19, 117.23–117.25; 206/144, 150, 192, 390; 383/6, 13, 25, 29; 493/339, 340, 374, 402; D9/434

(56) References Cited

U.S. PATENT DOCUMENTS

D. 317,246 * 6/1991 Driscoll ..... 294/171 X
874,515 * 12/1907 Lorenz ..... 493/340 X
1,819,142 * 8/1931 Wily ..... 294/57
2,004,396 * 6/1935 Sage ..... 493/340 X
2,846,134 * 8/1958 Moubayed ..... 294/27.1 X
3,688,935 * 9/1972 Owen et al. ..... 294/31.2 X
4,871,264 * 10/1989 Robbins et al. ..... 294/171 X
5,257,845 * 11/1993 McConnell ..... 294/171
5,658,029 * 8/1997 Franko ..... 294/171

* cited by examiner

*Primary Examiner*—Johnny D. Cherry
(74) *Attorney, Agent, or Firm*—Tod R. Nissle, P.C.

(57) ABSTRACT

A method for producing grips cuts a strip of material to form at least two columns of grips. Each column includes a plurality of grips end-to-end. Each grip formed in the strip of material is of equal shape and dimension. The sides of each grip are shaped such that the edge of one column can be nested with and coincide with the edge of another column to permit both edges to be cut simultaneously without producing any wasted material between the edges. Each grip includes lines of weakening, includes at least one point with a pair of sides, and includes a pair of edges which are adjacent the sides of the point. When each grip is folded along the lined of weakening, the pair of edges adjacent the point separate and expose the point.

10 Claims, 5 Drawing Sheets

FIG. 2
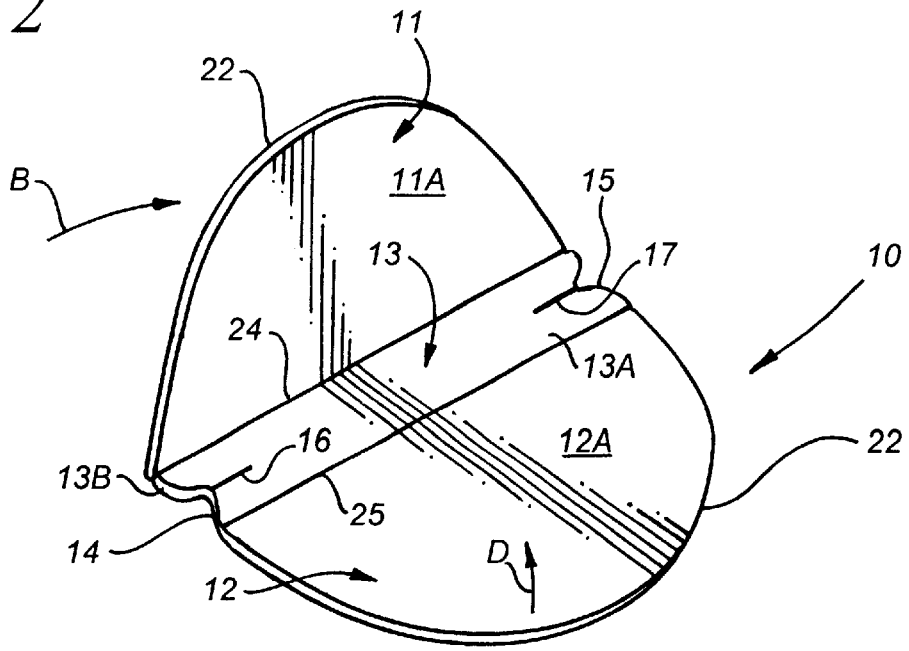
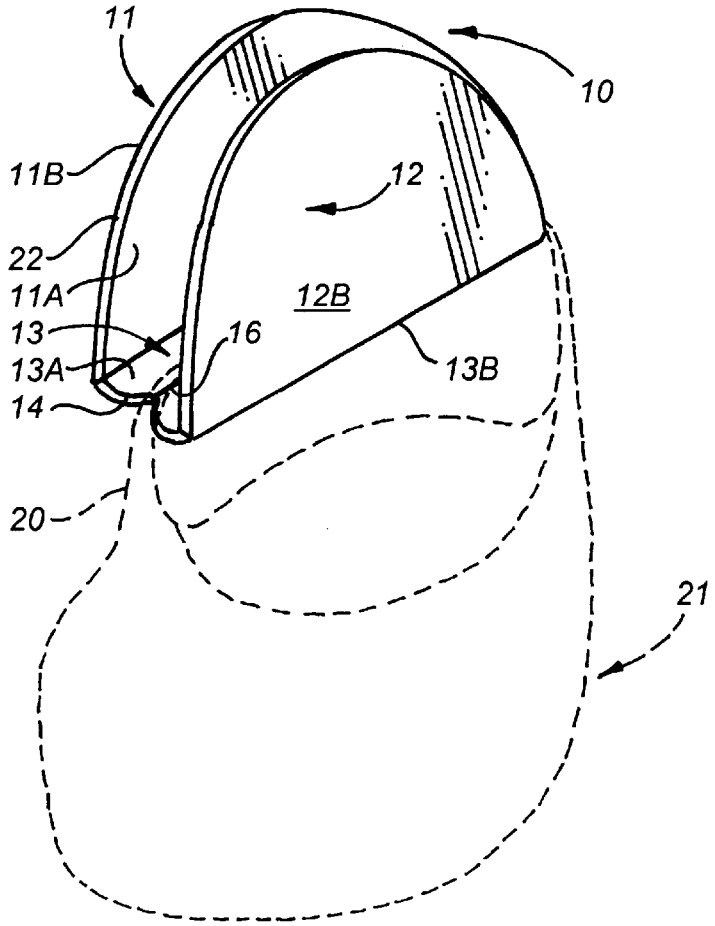
FIG. 3

FIG. 5
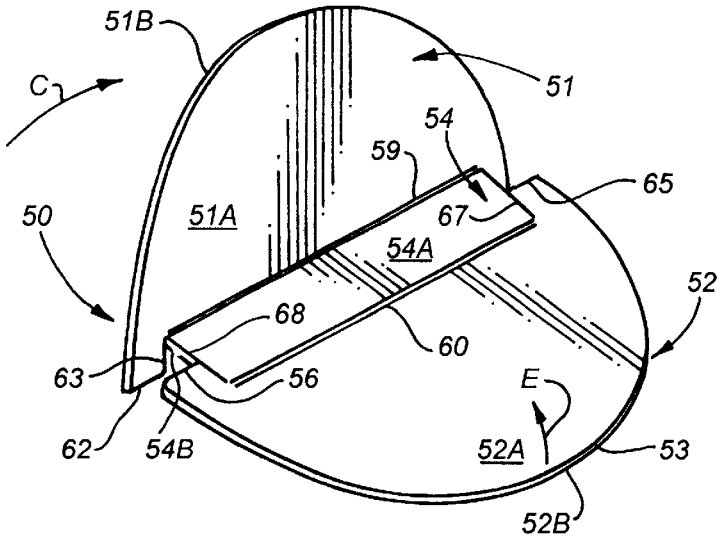
FIG. 6
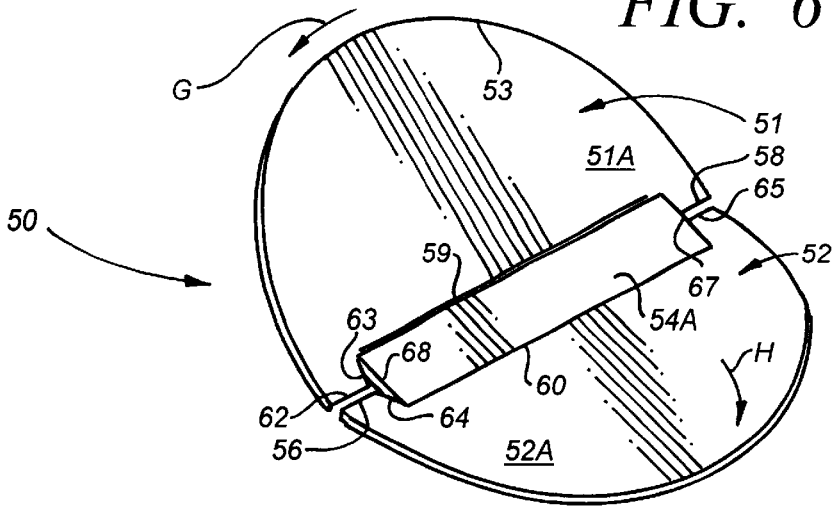
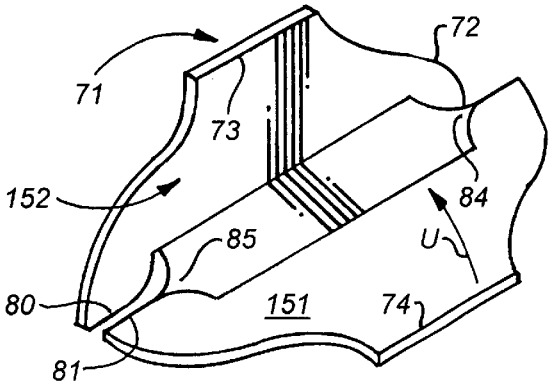
FIG. 8

FIG. 9A
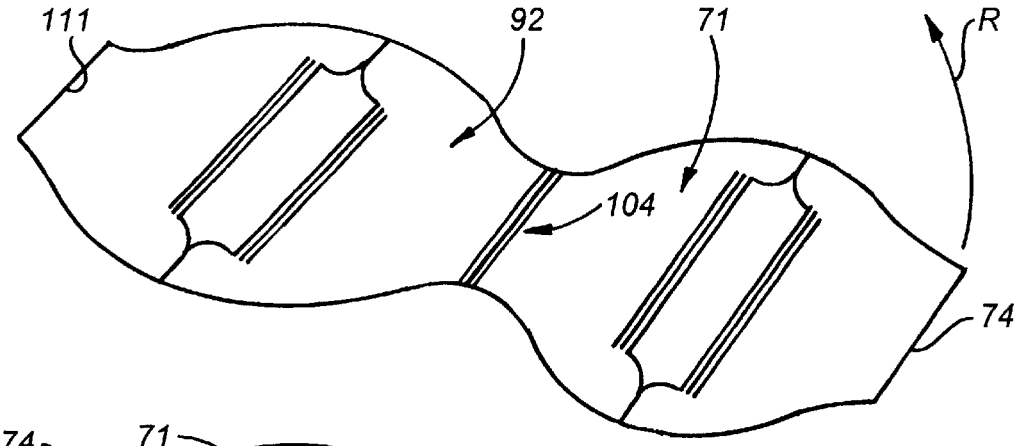
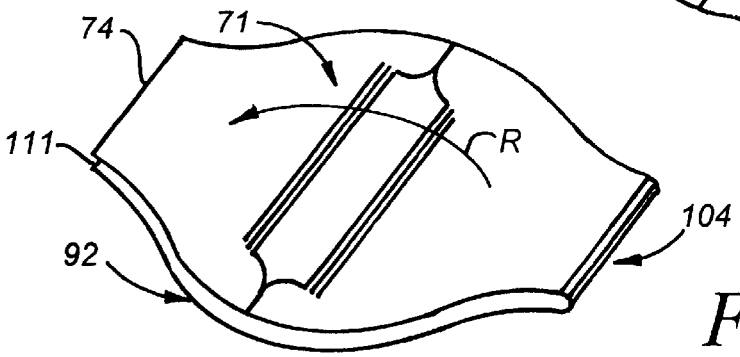
FIG. 9B
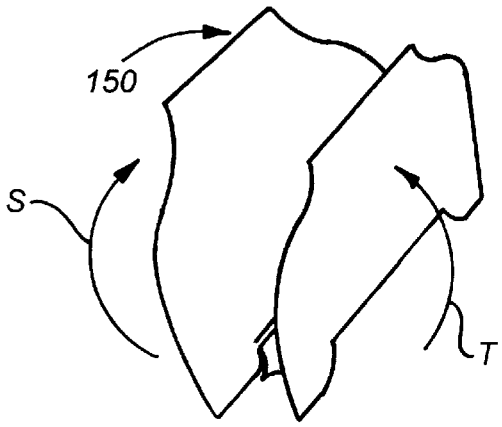
FIG. 9C

METHOD FOR CUTTING STRIP TO PRODUCE GRIPS FOR BAG

This application is a continuation-in-part of application Ser. No. 08/964,555 filed Nov. 5, 1997, now abandoned.

This invention relates to handles for bags or other containers.

More particularly, the invention relates to a grip for a bag with pliable plastic handles.

In another respect, the invention relates to a plastic bag having a pliable thin plastic handle which rolls into a thin strand that injures the hand of a person carrying the bag by holding the handle.

For many years, paper bags were utilized to bag groceries, clothes, and other items purchased in retail stores. In an effort to reduce the consumption of paper and to conserve forest resources, plastic bags came into use. One type of bag widely utilized in grocery stores to pack food articles is a pliable bag made from thin sheet plastic material. While such "standard" plastic bags are lightweight and relatively strong, each standard bag includes a pair of U-shaped handles that are cut from the same thin plastic used to make the remainder of the bag. The handles are typically about an inch wide. When, however, these U-shaped handles are grasped by an individual to carry a standard bag, the handles roll and compress into a thin string-like strand which tends to dig into the hand of an individual, sometimes painfully. In order to remedy this situation, auxiliary handles or grips have been developed which are fabricated from hard plastic or metal, are easily comfortably grasped, and permit the handles of a standard plastic bag to be threaded through the auxiliary grip. Such auxiliary grips do not appear ever to have come into widespread use, likely because the manufacturing cost was prohibitive, and because individuals shopping at a store would rather endure the short-term pain caused by carrying a plastic bag than purchase and carry an auxiliary grip.

Accordingly, it would be highly desirable to provide an improved auxiliary grip which is practical in manufacture and use and which could be utilized in conjunction with plastic shopping bag handles or other bag handles which dig into the hand.

Therefore, it is a principal object of the invention to provide an improved grip for the handle of a bag or other container.

A further object of the invention is to provide an improved grip for use in conjunction with bag handles which injure a user's hand.

Another object of the invention is to provide a grip which after being deformed has memory and returns, at least in part, to its original shape.

Still a further object of the invention is to provide an improved grip which, on being grasped, deforms to produce an opening which traps a bag handle and holds the grip on the bag handle after the grip is released by a user.

Yet a further object of the invention is to provide an improved grip which, when utilized to cradle a bag handle, is deformed by the bag handle to interlock the bag handle with the grip.

These and other, further and more specific objects and advantages of the invention will be apparent to those skilled in the art from the following detailed description thereof, taken in conjunction with the drawings, in which:

FIG. 2 is a perspective view of the grip of FIG. 1 illustrating one portion of the grip folded from the orientation shown in FIG. 1 to a position permitting the grip to receive and cradle a portion of the handle of a bag;

FIG. 3 is a perspective view of the grip of FIG. 1 illustrating the mode of operation thereof;

FIG. 5 is a perspective view of the grip of FIG. 4 illustrating one portion of the grip folded to a position permitting the grip to receive and cradle a portion of the handle of a bag;

FIG. 6 is a perspective view of the grip of FIG. 4 after the grip has been folded into a U-shaped orientation (similar to the orientation of the grip shown in FIG. 3), has been released, and has partially elastically returned to the unfolded orientation illustrated in FIG. 4; and FIGS. 7 to 9C illustrate alternate embodiments of the hand grip of the invention.

Briefly, in accordance with my invention, I provide an improved grip for a bag. The bag includes at least one handle. The improved grip includes a panel of material having a top, a bottom, and a peripheral edge; and, a spaced apart pair of lines of weakening formed in the panel. The panel is foldable along the lines of weakening into a U-shaped grip for receiving and cradling a portion of the handle.

In another embodiment of the invention, I provide an improved grip for a bag. The bag includes at least one handle. The grip includes a panel member for receiving and cradling a portion of the handle; and, a retention system for engaging a section of the handle to affix the grip to the handle. The retention system is deformable by the handle as a result of the force of gravity generating a downward force on the handle.

In a further embodiment of the invention, I provide a grip for a bag. The bag includes at least one handle. The improved grip includes a panel member for receiving and cradling a portion of the handle; and, at least one slit formed in the panel member to frictionally engage a section of the handle.

In still another embodiment of the invention, I provide a memory grip for a bag. The bag includes at least one handle. The grip includes a memory panel member movable between at least three operative positions, a first normal operative position, a second folded operative position to receive and cradle a portion of the handle, and, a third memory operative position intermediate the first and second operative positions wherein the memory panel member has moved from the second folded operative position to partially return to the first operative position.

Figure 1:
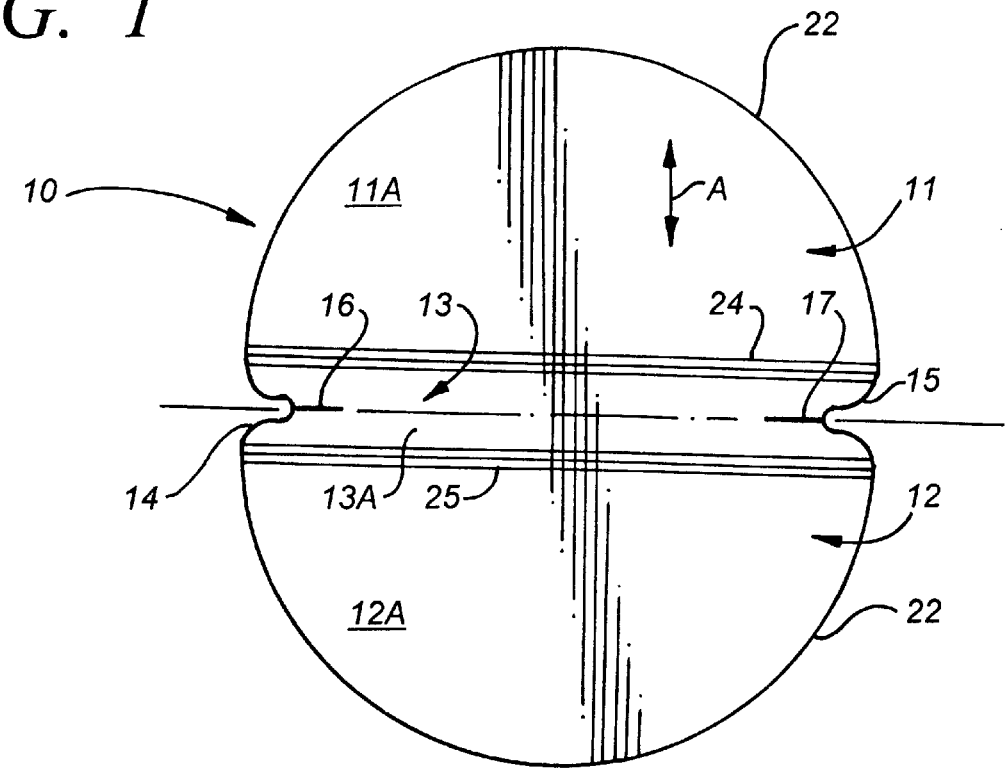
FIG. 1 is a top view illustrating a grip constructed in accordance with the principles of the invention.

Turning now to the drawings which depict the presently preferred invention for the purpose of describing the use thereof and not by way of limitation of the scope of the invention, and in which like reference characters refer to corresponding elements throughout the several views, FIGS. 1 to 3 illustrate one embodiment of the invention comprising a grip 10 including peripheral edge 22, base 13, outer portion 11, and outer portion 12. Portion 12 is connected to base 13 along line(s) of weakening 25. Portion 11 is connected to base 13 along line(s) of weakening 24. Portion 11 includes a top surface 11A and back surface 11B. Portion 12 includes a top surface 12A and back surface 12B. Portion 13 includes a top surface 13A and a back surface 13B. The front surface of grip 10 includes surfaces 11A, 12A, 13A. The back surface of grip 10 includes surfaces 11B, 12B, 13B. Notches 14 and 15 are formed in the ends of base 13. Slots 16 and 17 each extend from the surface 13A to surface 13B and extend inwardly from notches 14 and 15, respectively.

While grip 10 can be fabricated from any desired material, a corrugated cardboard is presently preferred, particularly a "B" Kraft material. Kraft material is corrugated "board" that comes in A, C, B, E, F, and N thicknesses, where A is the thickest, C is the next thickest, then B, etc. In FIG. 1, the longitudinal axes of the corrugations or flutes in grip 10 are preferably parallel to arrows A. Such an orientation of the flutes, although not required, facilitates incorporating "memory" into grip 10 such that after the grip 10 is folded along lines 24, 25 to the orientation shown in FIG. 3, grip 10 will, after being released, return partially to its original flat orientation (or other desired orientation) illustrated in FIG. 1.

In use of grip 10, portion 11 is folded about line of weakening 24 in the direction of arrow B to the position shown in FIG. 2 where portion 11 is normal to base 13. Portion 12 is then folded in the direction of arrow D about line of weakening 25 to a position where portion 12 is (as illustrated in FIG. 3) normal to base 13. Handle 20 of a bag 21 is cradled in grip 10 in the manner shown in FIG. 3, and grip 10 is grasped by the hand of a user to lift and carry bag 21. When the user grasps grip 10, the inside of the user's hand normally contacts the back surface of grip 10, namely surfaces 12B, 13B, 11B. The portion of handle 20 intermediate portions 11 and 12 in FIG. 3 contacts and rests on surface 13A. The weight of groceries (i.e., the gravitational pull on the groceries) or other articles carried in bag 21 pulls sections of handle 20 into slots 16 and 17. Once sections of handle 20 are forced into slots 16 and 17, the user can release and drop grip 10. After grip 10 is dropped by the user, slots 16 and 17 continue to frictionally engage sections of handle 20, retaining grip 10 on handle 20.

Figure 4:
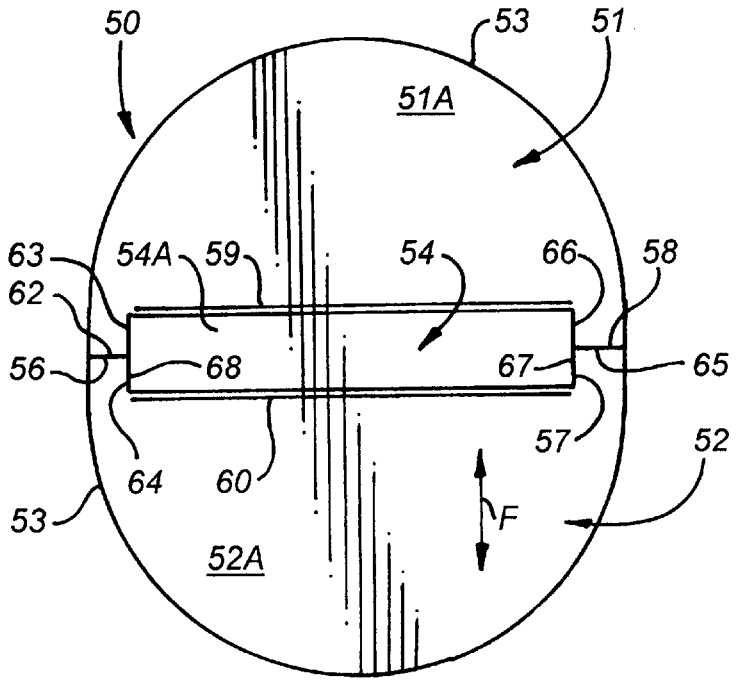
FIG. 4 is a top view illustrating a grip constructed in accordance with an alternate embodiment of the invention.

FIGS. 4 to 6 illustrate another embodiment of the invention comprising a grip 50 including peripheral edge 53, base 54, outer portion 51 and outer portion 52. Portion 52 is connected to base 54 along line(s) of weakening 60. Portion 51 is connected to base 54 along line(s) of weakening 59. Portion 51 includes a top surface 51A and back surface 51B. Portion 52 includes a top surface 52A and back surface 52B. Portion 54 includes a top surface 54A and a back surface 54B. The front surface of grip 50 includes surfaces 51A, 52A, 54A. The back surface of grip 50 includes surfaces 51B, 52B, 54B. T-shaped die cuts are formed at the ends of base 54. The "leg" of the T-shaped die cut at the left hand end of base 54 in FIG. 4 includes edge 56 on portion 52 and opposing edge 62 on portion 51. The "top" or "cross" of the T-shaped die cut at the left hand end of base 54 includes edge 68 on base 54 and opposing edges 63 on portion 51 and 64 on portion 52. The "leg" of the T-shaped die cut at the right hand end of base 54 in FIG. 4 includes edge 65 on portion 52 and opposing edge 58 on portion 51. The "top" or "cross" of the T-shaped die cut at the left hand end of base 54 includes edge 67 on base 54 and opposing edges 66 on portion 51 and 57 on portion 52.

Edges 62 and 63 partially bound and define a short rectangular leg which extends from the main body of semi-circular portion 51 along the left end (in FIGS. 4 to 6) of base 54. Edges 56 and 64 partially bound and define a short rectangular leg which extends from the main body of semi-circular portion 52 also along the left end of base 54.

Edges 58 and 66 partially bound and define a short rectangular leg which extends from the main body of semi-circular portion 51 along the right end (in FIGS. 4 to 6) of base 54. Edges 65 and 57 partially bound and define a short rectangular leg which extends from the main body of semi-circular portion 52 also along the right end of base 54.

While grip 50 can be fabricated from any desired material, a corrugated cardboard is presently preferred, particularly a "B" Kraft material. Kraft material is corrugated "board" that comes in A, C, B, E, F, and N thicknesses, where A is the thickest, C is the next thickest, then B, etc. In FIG. 4, the longitudinal axes of the corrugations or flutes in grip 50 are preferably parallel to arrows F. Such an orientation of the flutes facilitates incorporating "memory" into grip 50 such that after the grip 50 is folded along lines 59, 60 to a U-shaped orientation similar to that of grip 10 in FIG. 3, portions 51 and 52 will, after grip 50 is released, pivot about lines of weakening 59 and 60, respectively, to the orientation illustrated in FIG. 6. When portions 51 and 52 pivot about base 54 to the position shown in FIG. 6, sections of a bag handle 20 which extend over surface 54A and down toward the ground (in the manner illustrated in FIG. 3 for grip 10) are pinched between the opposing edges in one or more edge pairs 58-65, 66-67, 57-67, 62-56, 63-68, and 64-68. For example, a section of handle 20 can be pinched between opposed edges 56 and 62. Pinching sections of bag handle 20 between any of said pairs of edges locks grip 50 onto handle 20 so that a user can set bag 21 on the ground, release grip 50, and later grasp grip 50 (which is still affixed to handle 20) to use grip 50 to carry the bag 21 to another location.

In use of grip 50, portion 51 is folded about line of weakening 59 in the direction of arrow C to the position shown in FIG. 5 where portion 51 is normal to base 54. Portion 52 is then folded about line of weakening 60 in the direction of arrow E to a position where portion 52 is (in the manner illustrated in FIG. 3 for portion 12 of grip 10) normal to base 54. Handle 20 of a bag 21 is cradled in grip 50 in the manner shown in FIG. 3 for grip 10, and grip 50 is grasped by the hand of a user to lift and carry bag 21. The inside of the user's hand normally contacts the back surface of grip 50, namely surfaces 51B, 52B, 54B. The portion of handle 20 intermediate portions 11 and 12 in FIG. 3 contacts and rests on surface 54A; base 54 is intermediate (1) the portion of handle 20 contacting base 54, and (2) the hand grasping and extending under grip 50. The weight of groceries or other articles carried in bag 21 pulls taut the sections of handle 20 extending over the ends of base 54 toward the ground. After a user sets down bag 21 and releases grip 50, portions 51 and 52 elastically begin to return in the directions indicated by arrow G and H, respectively, to their original unfolded orientation illustrated in FIG. 3. Normally, however, portions 51 and 52 do not completely return to their original unfolded orientation, but only move to an intermediate position like the one illustrated in FIG. 6. As earlier noted, when portions 51 and 52 move in the directions indication by arrows G and H, respectively, sections of handle 20 are pinched between an opposed pair of edges in one of the edge pairs 58-65, 66-67, 57-67, 62-56, 63-68, and 64-68.

When a section of handle 20 slides and/or is forced into a slit 16, 17 or when a section of handle 20 is pinched between an opposing pair of edges comprising one or more of the edge pairs 58-65, 66-67, 57-67, 62-56, 63-68, and 64-68, some of the paper comprising the corrugated board preferably utilized in the invention typically is bent or deformed from its normal position. As would be appreciated by those of skill in the art, the paper most likely to be deformed is the paper immediately adjacent a slit 16, 17 or edge 58, 65, 66, 67, 57, 67, 62, 56, 63, 68, 64, 68. Such a deformation occurs because the section of handle 20 slid, compressed, or otherwise forced into a slit or between a pair of opposing edges takes up more space than is normally in a slit or between a pair of opposing edges.

When grips 10 or 50 are fabricated from Kraft material, folding the grips from their flat configuration illustrated in FIGS. 1 and 4 to a U-shaped configuration of the type illustrated in FIG. 3 stretches paper at or near the fold lines and on the outside (i.e., on the back surface of the grip) of the fold lines. This stretched paper has some elasticity and is at least in part responsible for the ability of the folded portions 11, 12 or 51, 52 to return partially to their initial flat orientation when said portions are released and permitted to move freely. In addition, when portions 11, 12 or 51, 52 are folded, paper on the inside (i.e., on the front surface of the grip) of the fold lines is compressed. This compressed paper is believed to have some resiliency and to at least in part be responsible for the ability of the folded portions 11, 12 or 51, 52 to return partially to their initial flat orientation when said portions are released and permitted to move freely. The orientation of fibers in fiberboard indicated by arrows M in FIG. 7 is perpendicular to the orientation of fluting in corrugated cardboard indicated by arrows A and F in FIGS. 1 and 4.

Figure 7:
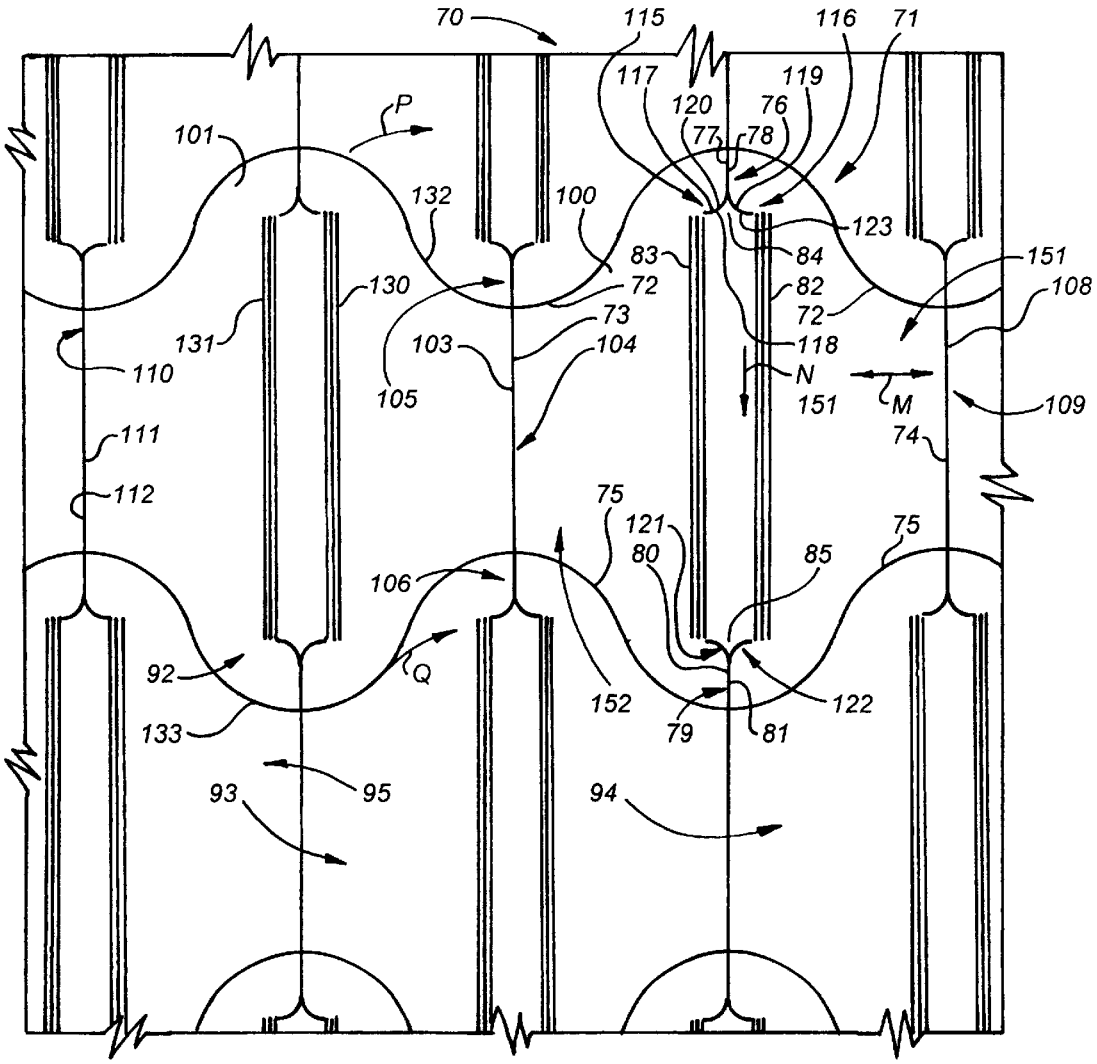

An alternate embodiment of the invention is illustrated in FIG. 7. In FIG. 7, nested strips or lengths of end-to-end handles are die cut into a strip 70 of fiber board, corrugated paper, or other material. Each handle 71, 92 to 94 has a shape and dimension equivalent to the other handles die cut in strip 70. Handle 71 includes a pair of opposed, spaced apart arcuate bell-shaped ends having peripheral edges 72, 75, and includes a pair of opposed spaced apart linear peripheral edges 73, 74 each interconnecting edges 72 and 75. Edges 72 to 75 are formed by die cutting strip 70. Consequently, handle 71 can be punched out of strip 70, as can adjacent handles 92, 93, and 94. FIG. 8 illustrates handle 71 after it is punched out of strip 70 and is being folded into a U-shape to engage the handle 20 of a plastic bag in the manner generally illustrated in FIG. 3. In FIG. 8, once panel 151 is folded upwardly in the direction of arrow U to a position parallel panel 152, handle 71 will be in a U-shape ready to engage the handle 20 of a plastic bag.

Handle 71 is also die cut along line 76 to form opposing linear edges 77 and 78 and is cut along line 79 to form opposing linear edges 80 and 81.

Handle 71 is die cut along arcuate line 115 to form opposing arcuate edges 117 and 118. One end of edge 117 terminates at linear edge 77.

Handle 71 is die cut along arcuate line 116 to form opposing arcuate edges 119 and 123. One end of edge 119 terminates at linear edge 78.

Arcuate line 116 has a length and curvature identical to that of lines 115, 121, and 122. The length and shape of each line 115, 116, 121, 122 can vary as desired. The shape and dimension of one of lines 115, 116, 121, 122 need not be identical to that of the remaining lines 115. A line 115, 116, 121, 122 can be straight instead of curved. If a line 115, 116, 121, 122 is straight, it is preferred that the line be canted with respect to a line 76 or 79 and not be parallel or perpendicular to a line 76 or 79.

Arcuate edges 118 and 123 form point or tip 84. Tip 84 is important because when handle 71 is opened to an orientation similar to that of handle 10 in FIG. 3 such that edges 77 and 78 are spaced apart, edges 117 and 118 are spaced apart, and edges 119 and 123 are spaced apart, the handle of a plastic bag placed intermediate edges 117 and 118 is pulled over tip 84 by the weight of articles carrier in the bag. When the handle of the plastic bag is pulled over tip 84, one portion of the handle tends to slide over edge 123 while the other portion of the handle tends to slide over edge 118 so that tip 84 penetrates or stretches and engages the handle. Such a bifurcation of the bag handle over edges 118 and 123 reduces the risk that the handle will bunch up and cut into handle 71 in the direction of arrow N. Tip 85 functions in the manner described above for tip 84.

While, as earlier noted, strip 70 can be comprised of corrugated cardboard or "B" Kraft material, another embodiment of the invention utilized fiberboard. Fiberboard is not corrugated and is comprised of pulp from trees calendared in sheet form. Fiberboard can include elongate fibers each extending in a selected direction such that each fiber is generally parallel to the other fibers in the fiberboard. Fiberboard comprised of parallel fibers is preferred in the practice of the invention. The direction in which the fibers extend in the fiberboard is indicated by arrows M in FIG. 7. The fibers are generally parallel to arrows M. The orientation of fibers perpendicular to lines of weakening 82, 83, and to edges 77, 78, 80, and 81 is preferred in the practice of the invention because it reduces the risk that the handle of a plastic bag will cut through handle 71 in a direction perpendicular to arrows M and because it increases the ability of handle 71 when released from the U-shaped "open" orientation of the type shown in FIG. 3 to return elastically to an orientation which, like the orientation shown in FIG. 6 for handle 50, is closer to the original flat orientation illustrated in FIG. 7. When handle 71 begins to return from a U-shaped "open" orientation to an orientation closer to the flat orientation shown in FIG. 7, edges 77 and 78 move closer together and function to pinch and capture a portion of the plastic bag handle therebetween. Similarly, edges 117 and 118 move closer together, and edges 119 and 123 move closer together to pinch a portion of the plastic bag handle therebetween.

Die cut line 79 in handle 71 has a length identical to that of die cut line 76 in handle 71. Die cut lines 121 and 122 have lengths and shapes identical to that of lines 115 and 116.

In another embodiment of the invention, every other die cut line 110, 104, 109 is not die cut and, instead, a line of weakening is formed to facilitate the folding of one handle 92 on top of an adjacent handle 71. In this embodiment of the invention, in FIG. 7, for example, lines 110 and 109 are die cut, forming opposing edge pairs 111, 112 and 74, 108, respectively. Line 104 is not, however, die cut. Instead, a line of weakening is formed such that when handles 71 and 92 are punched out of strip 70, handles 71 and 92 are connected to each other only along the line of weakening formed along line 104, and, handles 71 and 92 are not connected to any other handles or any other portion of strip 70. A layer of adhesive is placed on planar surfaces 101 of handle 92 and/or planar surface 100 of handle 71. Surfaces 100, 101 extend between and to the peripheral edges of handles 71, 92, respectively. Handle 92 is folded in the direction of arrows P and Q along the line of weakening formed at line 104 and is thus folded into registration with handle 71. Surfaces 101 and 100 contact one another or the layer of adhesive therebetween, such that handles 92 and 71 form a bi-layer laminate having a thickness twice that of strip 70 or of either handle 92 or handle 71 alone. The folding of handles 71 and 92 in this fashion is further illustrated in FIGS. 9A and 9B where flat handle 71 is folded in the direction of arrow R into a position contacting, adjacent and in registration with handle 92 to form a bi-layer laminate 150 which has the same general shaped as handles 71 and 92 but which is twice as thick as each layer 71, 92.

Bi-layer laminate 150 includes (1) fold line or line of weakening 130 in handle 92 is immediately adjacent, contacting, and parallel to line of weakening 83 in handle 71, (2) line of weakening 131 is immediately adjacent, contacting, and parallel to line of weakening 82 in handle 71, (3) edge 111 is immediately adjacent edge 108, (4) arcuate edge 132 is immediately adjacent and conforms to bell-shaped arcuate edge 72, and (5) arcuate edge 133 is immediately adjacent and conforms to bell-shaped arcuate edge 75. In use, the bi-layer laminate 150 is folded along the lines of weakening 83, 131 and 82, 130 such that the bi-layer laminate takes on a U-shaped configuration generally similar to that shown in FIG. 3. The handle of a bag is then placed in the folded bi-layer laminate in a manner similar to that of handle 20 of bag 21 in FIG. 3. One particular advantage of folding handle pairs 92-71 to form a single handle in the manner just described is that a thinner strip 70 can be utilized because folding a pair of adjacent handles 71–92 doubles the width and increases the strength of the resulting handle laminate.

Die cutting handles 71, 92, 93, 94 in the manner illustrated in FIG. 7 is advantageous because each column 71, 92 adjacent another column 93, 94 has no stripping or waste material which must be removed from between the columns.

When strip 70 comprises fiberboard, the fiberboard preferably has a thickness in the range of 0.016 to 0.032 inch. Fiberboard is usually thinner than corrugated cardboard. Corrugated cardboard is generally always thicker than 0.028 inch. Fiberboard and corrugated cardboard are both made from cellulose fiber.

Having described my invention in such terms as to enable those skilled in the art to understand and practice it, and having identified the presently preferred embodiments thereof, I claim:

1. A method for making a plurality of grips for carrying a bag, said method comprising the steps of (a) providing a strip of material including an elongate axis and including parallel elongate fibers each generally parallel to said axis;

(b) cutting said strip of material to produce a first column consisting of grips end-to-end and a second column consisting of grips end-to-end such that, (i) each of the grips in said first and second columns includes a pair of spaced apart opposing bell-shaped sides (72, 75), (ii) said first column has a scalloped edge consisting collectively of a plurality of said bell-shaped sides end-to-end, (iii) said second column has a scalloped edge consisting collectively of a plurality of said bell-shaped sides end-to-end, (iv) said scalloped edge of said second column conforms to, nests in, and is adjacent said scalloped edge of said first column such that said strip includes a cut line which extends along both said scalloped edge of said first column and said scalloped edge of said second column, and (iv) the grips each include at least a pair of spaced apart lines of weakening (82, 83) perpendicular to said elongate axis and to said elongate fibers; and, (c) removing said first and second columns of grips from said strip of material.

2. The method of claim 1 wherein said lines of weakening are formed by creasing said strip of material.

3. A method for making a plurality of grips for carrying a bag, said method comprising the steps of (a) providing a strip of material including an elongate axis and including parallel elongate fibers each generally parallel to said axis;

(b) cutting said strip of material to produce a column of grips each (i) including a pair of spaced apart peripheral opposing sides (72, 75) each extending between a pair of peripheral edges (73, 74), (ii) including at least a pair of spaced apart lines of weakening (82, 83) perpendicular to said elongate axis and to said elongate fibers, and intermediate said peripheral edges, and (iii) having a generally flat orientation;

(c) removing from said strip of material the grips in said column;

(d) displacing, in each of the grips, said pair of peripheral edges toward each other to fold each grip along said lines of weakening from said flat orientation; and, (e) releasing each grip to permit said elongate fibers to cause the grip to return at least partially to said flat orientation.

4. The method of claim 3 wherein said lines of weakening are formed by creasing said strip of material.

5. A method for making a plurality of grips for carrying a bag, said method comprising the steps of (a) providing a strip of material including an elongate axis and including parallel elongate fibers each generally parallel to said axis;

(b) cutting said strip of material to produce a column of grips each (i) including a pair of spaced apart peripheral opposing sides (72, 75) each extending between a pair of peripheral edges (73, 74), (ii) including at least a pair of spaced apart lines of weakening (82, 83) perpendicular to said elongate axis and to said elongate fibers, arid intermediate said peripheral edges, (iii) including at least one tip (85) extending outwardly from between said lines of weakening and pointed toward one of said opposing sides (72, 75), (iv) including a pair of opposing edges each bordering a cut area and extending from said tip to said one of said opposing sides, and (v) having a generally flat orientation;

(c) removing from said strip of material the grips in said column;

(d) displacing, in each of the grips, said pair of peripheral edges toward each other to (i) fold each grip along said lines of weakening from said flat orientation, and (ii) separate said opposing edges and expose said tip; and, (e) releasing each grip to permit said elongate fibers to cause the grip to return at least partially to said flat orientation.

6. The method of claim 5 wherein said lines of weakening are formed by creasing said strip of material.

7. A method for making a plurality of grips for carrying a bag, said method comprising the steps of (a) providing a strip of material including an elongate axis and including parallel elongate fibers each generally parallel to said axis;

(b) cutting said strip of material to produce a column of grips each (i) including a pair of spaced apart peripheral opposing sides each extending between a pair of peripheral edges, (ii) including at least a pair of spaced apart lines of weakening perpendicular to said elongate axis and to said elongate fibers, and intermediate said peripheral edges, (iii) including at least one tip extending outwardly from between said lines of weakening and pointed toward one of said opposing sides, said tip including a nose and at least a pair of edges co-terminating at said nose, and (iv) including a pair of opposing edges each bordering a different one of said edges of said tip and extending to said one of said opposing sides such that when said grip is folded from said flat orientation along said lines of weakening to move said pair of peripheral edges toward each other, said opposing edges separate and move away from said edges of said tip to expose said tip; and, (c) removing from said strip of material the grips in said column.

8. The method of claim 7 wherein said lines of weakening are formed by creasing said strip of material.

9. A method for making a plurality of grips for carrying a bag, said method comprising the step of (a) providing a strip of material;

(b) cutting said strip of material to produce a column of grips each (i) including a pair of spaced apart peripheral opposing sides each extending between a pair of peripheral edges, (ii) including at least a pair of spaced apart lines of weakening perpendicular to said elongate axis and to said elongate fibers, and intermediate said peripheral edges, (iii) including at least one tip extending outwardly from between said lines of weakening and pointed toward one of said opposing sides, said tip including a nose and at least a pair of edges co-terminating at said nose, and (iv) including a pair of opposing edges each bordering a different one of said edges of said tip and extending to said one of said opposing sides such that when said grip is folded from said flat orientation along said lines of weakening to move said pair of peripheral edges toward each other, said opposing edges separate and move away from said edges of said tip to expose said tip; and, (c) removing from said strip of material the grips in said column.

10. The method of claim 9 wherein said lines of weakening are formed by creasing said strip of material.

* * * * *